US007854495B2

(12) United States Patent
Wanibe

(10) Patent No.: US 7,854,495 B2
(45) Date of Patent: Dec. 21, 2010

(54) LIQUID STORAGE TANK

(75) Inventor: Akihisa Wanibe, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 666 days.

(21) Appl. No.: 11/837,690

(22) Filed: Aug. 13, 2007

(65) Prior Publication Data

US 2008/0036832 A1 Feb. 14, 2008

(30) Foreign Application Priority Data

Aug. 11, 2006 (JP) ..... 2006-220757

(51) Int. Cl.
*B41J 2/14* (2006.01)

(52) U.S. Cl. ..... 347/50

(58) Field of Classification Search ..... 347/6, 347/19, 50, 68, 84–87; 101/480; 29/25.35, 29/595; 220/694; 73/54.28, 252, 290 R
See application file for complete search history.

(56) References Cited

U.S. PATENT DOCUMENTS 6,164,743 A * 12/2000 Hmelar et al. ..... 347/7
6,536,861 B1 * 3/2003 Usui et al. ..... 347/7
2006/0139393 A1 * 6/2006 Zhang et al. ..... 347/19
2006/0219726 A1 * 10/2006 Yajima et al. ..... 220/694
2006/0250426 A1 * 11/2006 Wanibe et al. ..... 347/7
2006/0250446 A1 * 11/2006 Wanibe et al. ..... 347/50
2006/0251430 A1 * 11/2006 Wanibe et al. ..... 399/1
2008/0291227 A1 * 11/2008 Yamamoto ..... 347/7

FOREIGN PATENT DOCUMENTS

JP 2001-146030 A 5/2001

* cited by examiner

*Primary Examiner*—Charlie Peng
(74) *Attorney, Agent, or Firm*—Sughrue Mion, PLLC

(57) ABSTRACT

A liquid storage tank includes a circuit chip equipped with a pair of chip contact points on a flat connection outer surface on a chip main body positioned at a predetermined position of a tank main body, and a pair of connection terminal plates each including a chip contact piece positioned around the circuit chip and extending from one side of the connection outer surface to make contact with the corresponding chip contact point, and another circuit connection portion conductively connected to a contact point of another circuit.

3 Claims, 10 Drawing Sheets

LIQUID STORAGE TANK

BACKGROUND

1. Technical Field

The present invention relates to a liquid storage tank and, in particular, to a liquid storage tank equipped with a circuit chip positioned at a predetermined position of a tank main body that stores a liquid. The liquid storage tank is also equipped with a connection terminal plate having a chip contact piece for pressing and making contact with a chip contact point on the circuit chip and for conductively connecting the chip contact point to a contact point of another circuit.

2. Related Art

The description below is given in the context of liquid consumption devices that employ liquid in, e.g., a recording operation. A common example of such a liquid consumption recording device is an ink jet printer, where the recording operation is usually a printing operation, the liquid used is ink, and the liquid storage tank is an easily changeable ink cartridge.

An ink supply opening is provided to a cartridge case (tank main body) storing a predetermined amount of the ink liquid in the ink cartridge for the ink jet type recording device. When the ink cartridge is attached to a cartridge attached portion of the printer, an ink supply needle equipped in the cartridge attached portion is inserted into and connected with the ink supply opening. This enables to supply the stored ink liquid to the printer.

The ink jet recording device performs recording of images and characters by sending the ink supplied from the ink cartridge to a recording head and by ejecting and applying an ink drop to a recording medium such as a paper by the recording head.

In the recording head of such an ink jet type recording device, the ejection of the ink drop is controlled by using heat or vibration. If an ink ejection operation is attempted, however, when the ink cartridge is empty and unable to supply ink (also referred to as an empty ejection), there is a possibility of failure.

Consequently, in the ink jet type recording device, it is necessary to watch the remaining amount of the ink liquid in the ink cartridge to prevent the empty ejection by the recording head.

Further, for example, when the recording device is to be used for different purposes like printing full color photographs in addition to monochrome text printing, the consumption rates and amounts of the different colors vary. Accordingly, in some of the recent ink jet type recording devices, there are a plurality of ink cartridges which can be individually exchanged so as to put into the recording device the kinds of ink cartridges suited for the use to which the recording device is to be put. In the case of such an ink jet type recording device, where cartridges can be used, removed, and used again, multiple times, it is necessary also to manage whether cartridges are new or used, and to manage how much ink has been used from cartridges. This kind of information may be thought of as a "used record".

Due to such a background, in the recent ink cartridge, various types of ink cartridges have been proposed. For example, an ink cartridge equipped with remaining amount detecting means for outputting a predetermined electric signal when the remaining amount of the ink liquid stored in the tank main body is consumed to a preliminary set threshold value or information recording means (memory) by which a control unit of the printer can write and read the information such as a type of the ink and the using record.

The ink remaining amount detecting means and the information storing means mounted in the ink cartridge are respectively prepared as a circuit chip made into one chip in consideration of assembling property of various ink cartridges to the tank main body, standardization of parts, and the like.

Then when the ink cartridge is designed, a device for saving the troubles of wiring and the like when assembling is required by, for example, conductively connecting a chip contact point equipped on the circuit chip as the remaining amount detecting means to a chip contact point of another circuit (for example, a circuit chip as information storing means) by using a connection terminal plate made of a metal plate.

FIG. 13 is an example of a conductive structure of a pair of chip contact points 2*a*, 2*b* on a sensor chip (circuit chip) 1 assembled to the tank main body as the remaining amount detecting means and a pair of chip contact pieces 5*a*, 5*b* of a connection terminal plate conductively connecting these chip contact points 2*a*, 2*b* to another circuit in the conventional ink cartridge.

The conductive structure shown here is same as the conductive structure shown in JP-A-2001-146030. A chip main body 1*a* in a flat rectangular solid state is a vibration plate and the upper surface of the chip main body 1*a* is a flat connection outer surface 1*b* on which the pair of chip contact points 2*a*, 2*b* are disposed in the sensor chip 1. A piezo element 6 as a piezoelectric element is disposed at the center of the chip main body 1*a* and an upper electrode 3*a* and a lower electrode 3*b* disposed at upper and lower sides of the piezo element 6 are respectively connected to the chip contact points 2*a*, 2*b*.

The pair of chip contact points 2*a*, 2*b* are equipped near a pair of opposite sides of the connection outer surface 1*b* as shown in FIG. 13. Each chip contact 2*a*, 2*b* is provided so as to be apart from the adjacent edges of the connection outer surface 1*b* by proper distances L1, L2.

The pair of chip contact pieces 5*a*, 5*b* are a part of the connection terminal plate respectively formed by press formation of a metal plate. A tongue portion 5*c* extending on the connection outer surface 1*b* from one side of the connection outer surface 1*b* is formed to the distal end of each chip contact piece 5*a*, 5*b*. As shown in FIG. 14A, conductive connection with the chip contact point 2*a*, 2*b* is accomplished by making contact the tongue portion 5*c* of the distal end to each chip contact point 2*a*, 2*b* in the state where the proximal side is elastically deformed.

However, in the ink cartridge having the conductive structure shown in FIG. 13, the position of the chip contact piece 5 may be misaligned in the direction in which the length of the tongue-shaped portion 5 of the chip contact piece 5 extending on the connection outer surface 1*b* is reduced as shown by the arrow X in FIG. 14B due to the assembling error of mutual parts, size tolerance of each part, and the like when assembled to the tank main body. In this case, the contact of the tongue portion 5*c* to an edge 1*c* of the connection outer surface 1*b* prevents the tongue portion 5*c* from making contact with the chip contact point 2*b* or reduces the contact pressure, even when the contact is made, resulting in electric connection problems. Accordingly, the design of sensor chip 1 leaves room for the possibility of operational faults.

Two ways described below are considered as methods for preventing the occurrence of such a disadvantage.

One approach is to regulate the positioning and setting of the tolerance of each part. The goal of such an approach is to minimize the positional misalignment of the chip contact pieces 5*a*, 5*b* generated by assembling error, size tolerance, and the like of each part is generated in the direction in which the length of the tongue portion 5*c* of the chip contact piece 5*a*, 5*b* extending on the connection outer surface 1*b* is increased (opposite direction to the arrow X in FIG. 14B).

Another way is to prevent the occurrence of the positional misalignment itself by improving the assembling accuracy by reducing the tolerance of each part or by finely adjusting assembling after each part is attached.

However, the former approach makes it impossible to keep a sufficient gap distance between the tongue portion 5*c* of the chip contact piece 5*a*, 5*b* and the piezo element 6 and the like. That is to say, the former approach introduced a new risk that the upper electrode 3*a* would make contact with the chip contact piece 5.

On the other hand, in the latter approach, the manufacturing cost of the ink cartridge might be considerably increased due to the increase of the manufacturing cost of each part, and the impact on productivity caused by having to devote more labor to the fine adjustment operation of the assembling position.

Further, in spite of applying such responses, for example, when the length of the chip contact point 2*b* along the positional misalignment direction and the edge of the connection outer surface 1*b* is elongated by an anticipated amount in anticipation of the positional misalignment in the direction shown by the arrow X in FIG. 14B, there exists a problem in that the size of the sensor chip 1 is enlarged, possibly resulting in the upsizing of the ink cartridge to which the sensor chip 1 is assembled.

SUMMARY

An advantage of some aspects of the invention is that it provides an inexpensive and miniaturized liquid storage tank which makes it possible to surely conductively connect a chip contact point of a circuit chip assembled to a tank main body and a chip contact piece of a connection terminal plate and to avoid disadvantage that the chip contact piece makes contact with the circuit chip except the chip contact point.

According to an aspect of the invention, there is provided a liquid storage tank including a tank main body for storing a liquid supplied to a liquid consumption device and attached to a tank attached portion of the liquid consumption device in a detachable manner, a circuit chip equipped with a pair of chip contact points on a flat connection outer surface on a chip main body positioned at a predetermined position of the tank main body, and a pair of connection terminal plates each including a chip contact piece positioned around the circuit chip in the tank main body and extending on the connection outer surface from one side of the connection outer surface to make contact with the corresponding chip contact point, and another circuit connection portion conductively connected to a contact point of another circuit. The pair of connection terminal plates conductively connect the corresponding chip contact point to the other circuit. Each chip contact point has an extending portion extending to an edge of one side of the connection outer surface at a rim positioned at one side of the connection outer surface to which the corresponding chip contact piece extends.

According to the above structure, the extending portion that extends to the edge of one side of the connection outer surface is provided to the chip contact point on the connection outer surface of the circuit chip at the rim positioned at one side of the connection outer surface to which the chip contact piece extends.

Consequently, the distal end of the chip contact piece can surely make contact with the extending portion of the circuit chip even when the position of the chip contact piece is misaligned in the direction in which the length of the chip contact piece extending on the connection outer surface of the chip main body is reduced and the distal side of the chip contact piece is positioned on the edge of the connection outer surface due to the assembling error of mutual parts, size tolerance of each part, and the like when the circuit chip and the connection terminal plate are assembled to the tank main body.

That is, the chip contact point of the circuit chip and the chip contact piece of the connection terminal plate assembled to the tank main body can be surely conductively connected by only managing the position of the chip contact piece so that the length of the chip contact piece extending on the connection outer surface of the chip main body is reduced.

In addition, the chip contact point of the circuit chip and the chip contact piece of the connection terminal plate assembled to the tank main body can be surely conductively connected without reducing the positional misalignment by enhancing the assembling accuracy of each part to the tank main body or improving the manufacturing accuracy of each part. Accordingly, the cost reduction can be realized and the productivity can be improved by reducing the manufacturing cost by reducing the assembling accuracy and manufacturing accuracy.

Note that it is preferable that a predetermined gap distance is assured between the edge of the opposite side of the connection outer surface opposing the edge to which the extending portion extends and the rim of the chip contact point. According to one aspect of the invention, the design can provide for at least a predetermined minimum gap distance.

According to the liquid storage tank having such a structure, when, for example, a large number of circuit chips are formed on one wafer in an adjacent manner in the manufacturing process of the circuit chip, no continuation of the chip contact points occurs between the adjacent circuit chips.

Accordingly, the productive efficiency of the sensor chip can be improved by employing the production method in which polarization process is collectively performed before the large number of circuit chips formed on one wafer in an adjacent manner are separated to each other.

Further, it is preferable that the pair of chip contact points are respectively provided at the opposite sides of the connection outer surface of the circuit chip, thereby providing opposing chip contact points, and the respective extending portions of each of the opposing chip contact points respectively extend toward the opposite side with respect to the opposing chip contact points to reach the edge of one side of the connection outer surface and, the positions of the extending portions of the opposing chip contact points are set so as not to overlap with the extending portions on the opposite side.

According to the liquid ink tank having such a structure, by providing a plurality of the extending portions along the rims of each chip contact point in a comb tooth manner, the contact area of each chip contact point and each chip contact piece can be increased to improve the conductive capability.

Consequently, a reduction portion may be formed to a conductor portion extending along the edge of the opposite side for each chip contact point. This makes it possible to save the resource of the conductor by reducing the width of the conductor.

BRIEF DESCRIPTION OF THE DRAWINGS

The invention will be described with reference to the accompanying drawings, wherein like numbers reference like elements.

FIG. 9A is an illustration view of the state where a chip contact piece is not misaligned to a chip contact point and FIG. 9B is an illustration view of the state where the chip contact piece is misaligned to the chip contact point in the direction in which the length of the chip contact piece extending on a connection outer surface is increased.

FIG. 14A is an illustration view of the state where the chip contact piece is not misaligned to the chip contact point, and FIG. 14B is an illustration view of the state where the chip contact piece is misaligned to the chip contact point in the direction in which the length of the chip contact piece extending on a connection outer surface is reduced.

DESCRIPTION OF EXEMPLARY EMBODIMENTS

Hereinafter, a preferable embodiment of a liquid storage tank according to the invention will be described in detail with reference to the accompanying drawings. Details unnecessary for a person familiar with this field to understand the invention have been omitted so as to avoid obscuring the main points.

Figure 1:
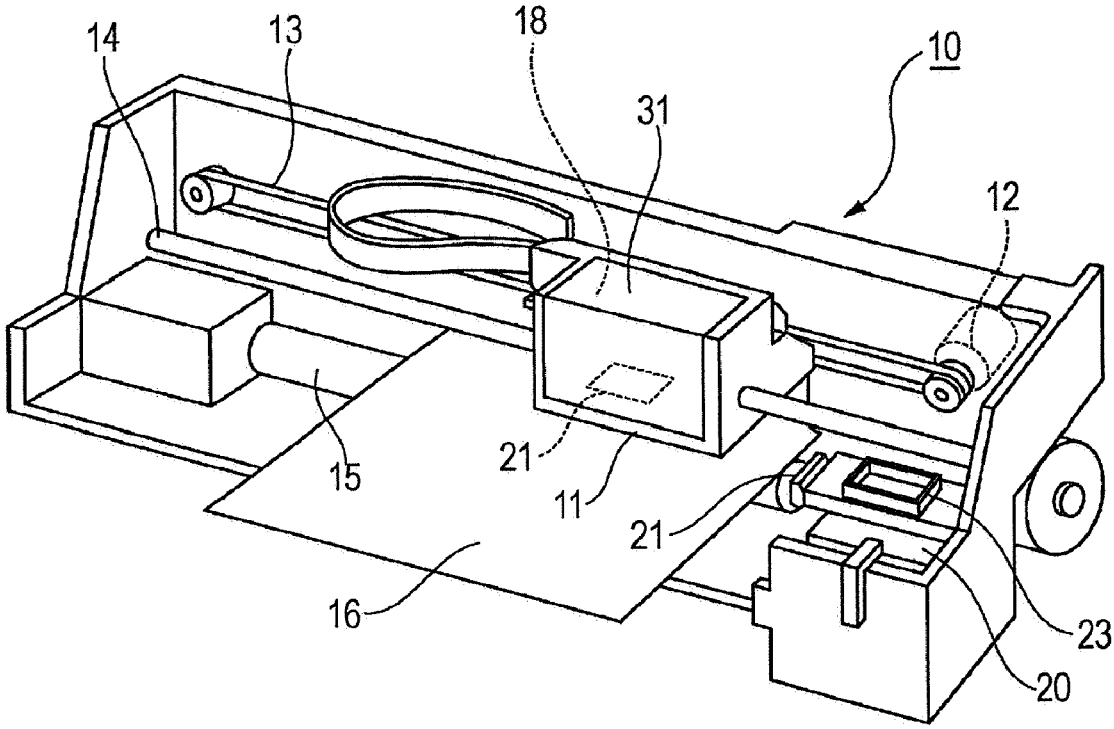
FIG. 1 is an overall perspective view of an ink jet type recording device to which an ink cartridge as a liquid storage tank is attached according to a first embodiment of the invention.

FIG. 1 is an overall perspective view of an ink jet type recording device to which an ink cartridge as a liquid storage tank is attached according to a first embodiment of the invention.

In an ink jet type recording device 10 shown in FIG. 1, a carriage 11 is constituted so as to be guided by a guide member 14 to be moved back and forth in the axis direction of a platen 15 via a timing belt 13 driven by a carriage motor 12.

An ink jet type recording head 22 is mounted on the carriage 11 at the opposing side of a recording paper 16. In addition, a cartridge attached portion 18 to which a plurality of ink cartridges 31 supplying ink to the recording head 22 are attached in a detachable manner is provided to the upper side of the ink jet type recording head 22.

A cap member 23 is disposed at the home position (right side of FIG. 1) which is a non-recording area of the ink jet type recording device. The cap member 23 is constituted so as to be pressed by a nozzle forming surface of the recording head 22 when the recording head 22 mounted on the carriage 11 is moved to the home position to form an enclosed space between with the nozzle forming surface. A pump unit 20 for performing cleaning and the like by providing a negative pressure to the enclosed space formed by the cap member 23 is disposed on the lower side of the cap member 23.

In addition, wiping means 21 equipped with an elastic plate such as rubber is disposed around the printing area side of the cap member 23 so as to be moved back and forth, for example, in the perpendicular direction to the movement locus of the recording head 22. The wiping means 21 is constituted so as to wipe the nozzle forming surface of the recording head 22 as required when the carriage 11 is moved back and forth to the cap member 23 side.

Figure 2:
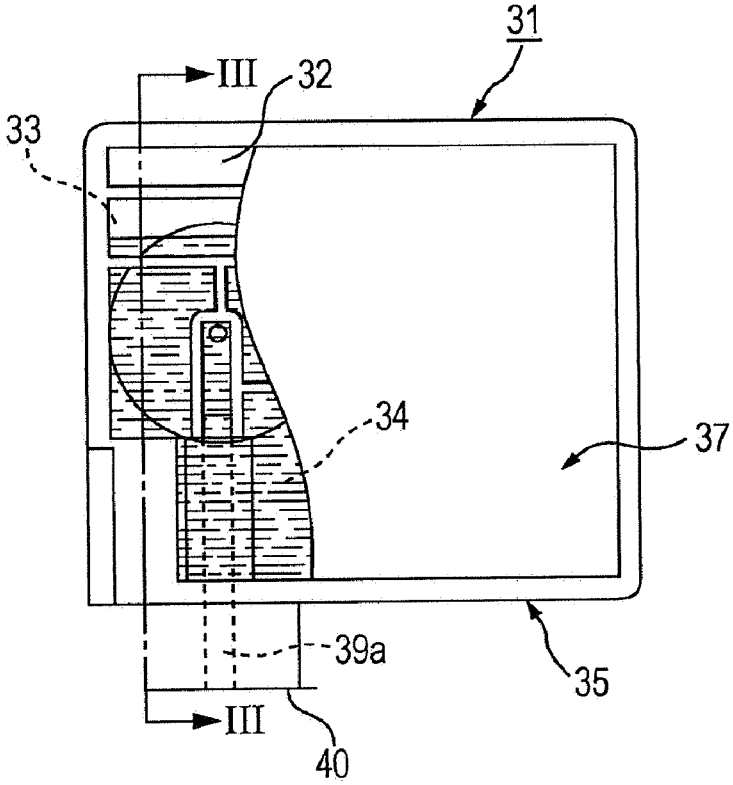
FIG. 2 is a partially cross sectional view of the ink cartridge as the liquid storage tank according to the first embodiment of the invention.
Figure 3:
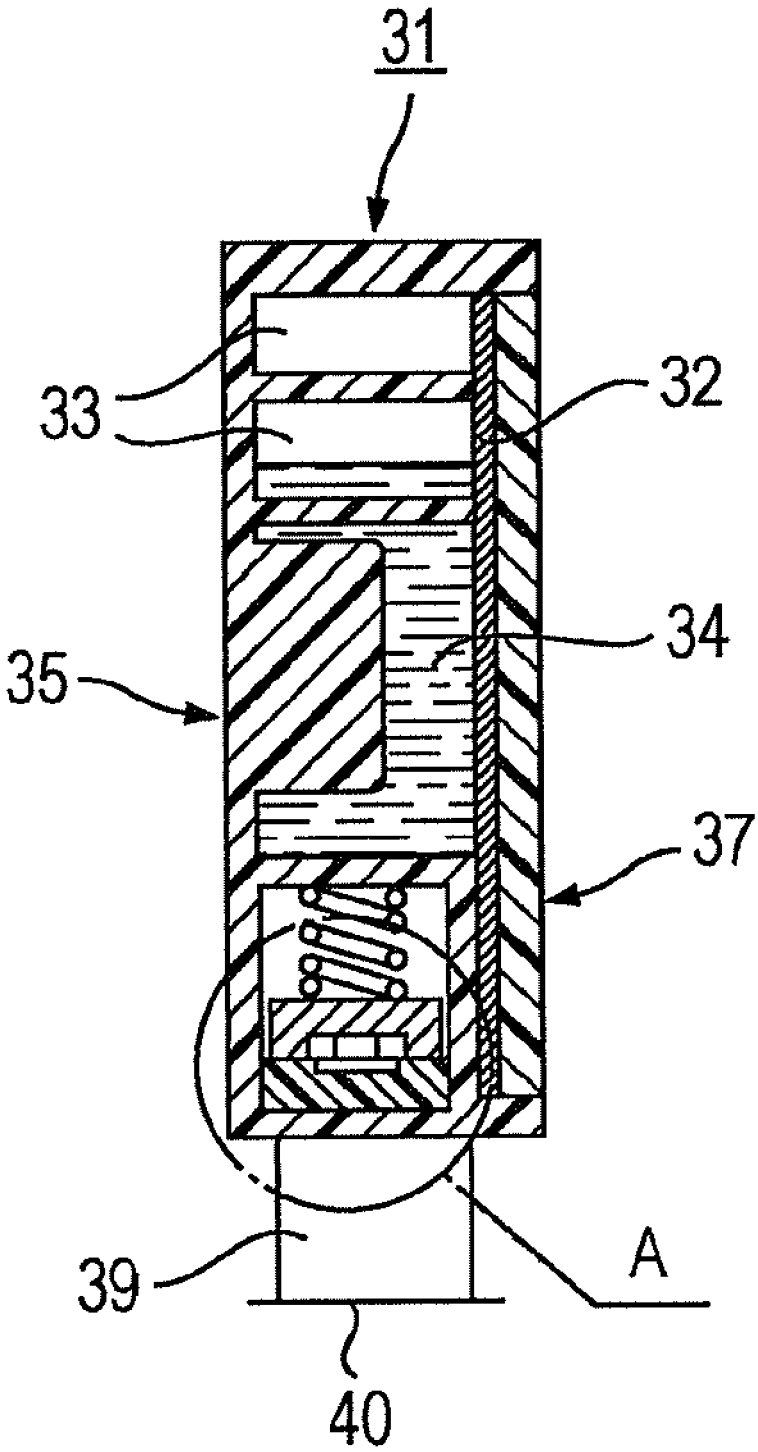
FIG. 3 is a cross sectional view taken along the line III-III of the ink cartridge shown in FIG. 2.
Figure 4:
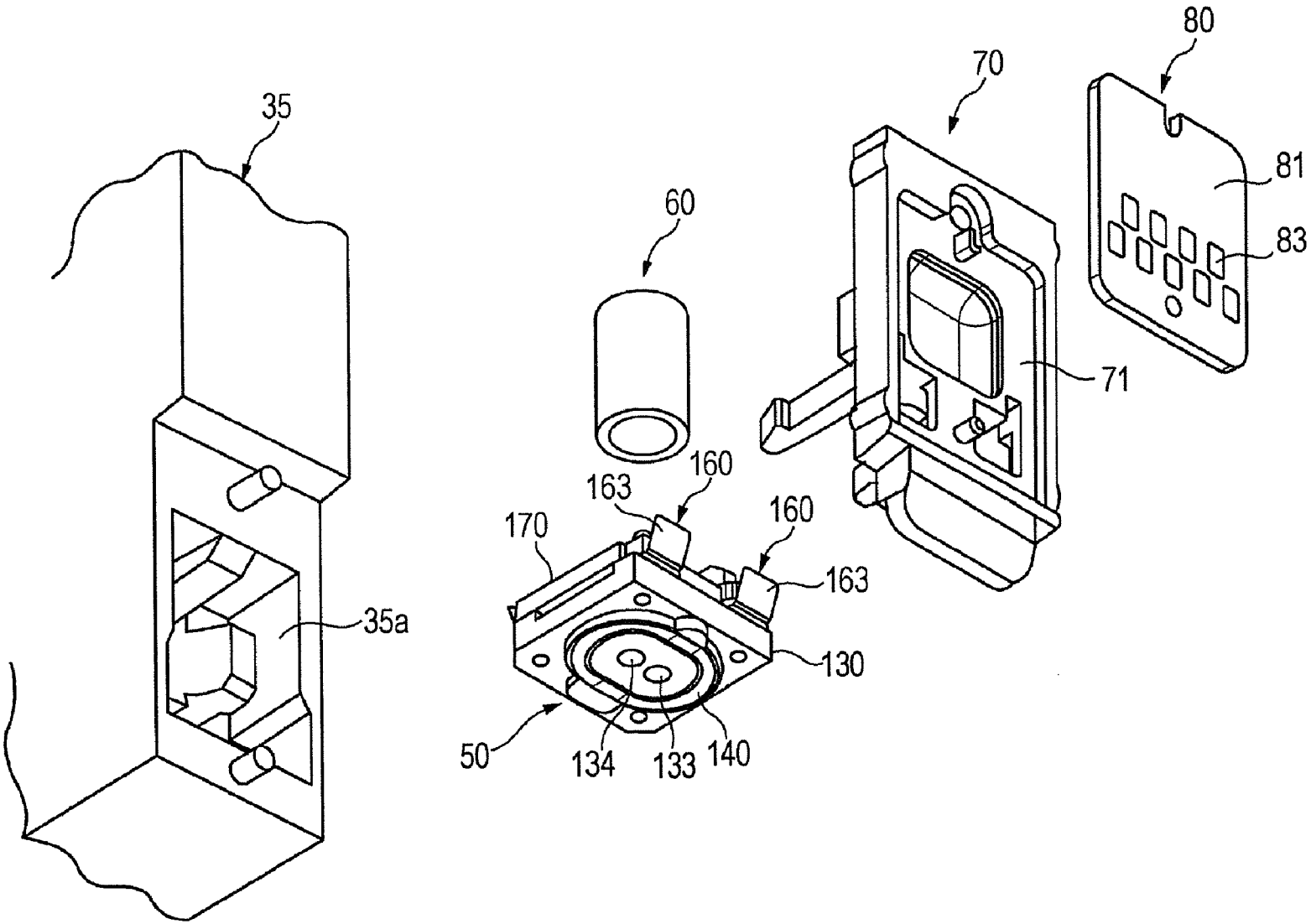
FIG. 4 is a decomposition perspective view of a substantial part showing an assemble structure of remaining amount detecting means and information storing means assembled to the tank main body of the ink cartridge shown in FIG. 2.

FIG. 2 is a partially cross sectional view of the ink cartridge as the liquid storage tank according to the first embodiment of the invention. FIG. 3 is a cross sectional view taken along the line III-III of the ink cartridge shown in FIG. 2. FIG. 4 is an explode perspective view of a substantial part showing a structure of remaining amount detecting means and information storing means assembled to the tank main body of the ink cartridge shown in FIG. 2.

As shown in FIGS. 2 and 3, the ink cartridge 31 is constituted by a tank main body 35 made of a resin in which an ink 34 is stored in an ink storage unit 33 formed by enclosing an open surface of one side by an enclosing film 32 and a cover 37 made of a resin for protecting the enclosing film 32 by covering the side surface of the enclosing film 32 side.

The tank main body 35 has an approximately rectangular parallelepiped shape, and an ink supply unit (liquid supply unit) 39 is provided to the bottom edge surface thereof so as to project therefrom. A cover film 40 for protecting an ink feed pocket 39*a* is stuck to the bottom edge surface of the ink supply unit 39.

A sensor placed concave portion 35*a* for placing a sensor unit 50 is opened at the bottom of the front edge surface of the tank main body 35 as also shown in FIG. 4. A sensor unit 50 and a sensor pressing spring 60 for pressing the sensor unit 50 in the bottom direction of the sensor placed concave portion 35*a* and sticking fast to an ink flow path opened at the bottom of the sensor placed concave portion 35*a* are inserted and attached in the sensor placed concave portion 35*a*.

The front surface opening of the sensor placed concave portion 35*a* in which the sensor unit 50 and the sensor pressing spring 60 are placed are sealed by a sealing cover 70 fitted and attached to the sensor placed concave portion 35*a*.

An IC chip substrate 80 is assembled to an approximately flat plate-like depression 71 of the front surface of the sealing cover 70. An IC chip as information storing means which can read and write information such as a type, a remaining amount, use history, and the like of the ink is mounted on the back surface of a flat plate-like circuit substrate 81 in the IC chip substrate 80. Substrate contact points 83 conductively connecting the IC chip with a connection terminal of the cartridge attached portion 18 side are equipped on the front surface of the circuit substrate 81.

Figure 5:
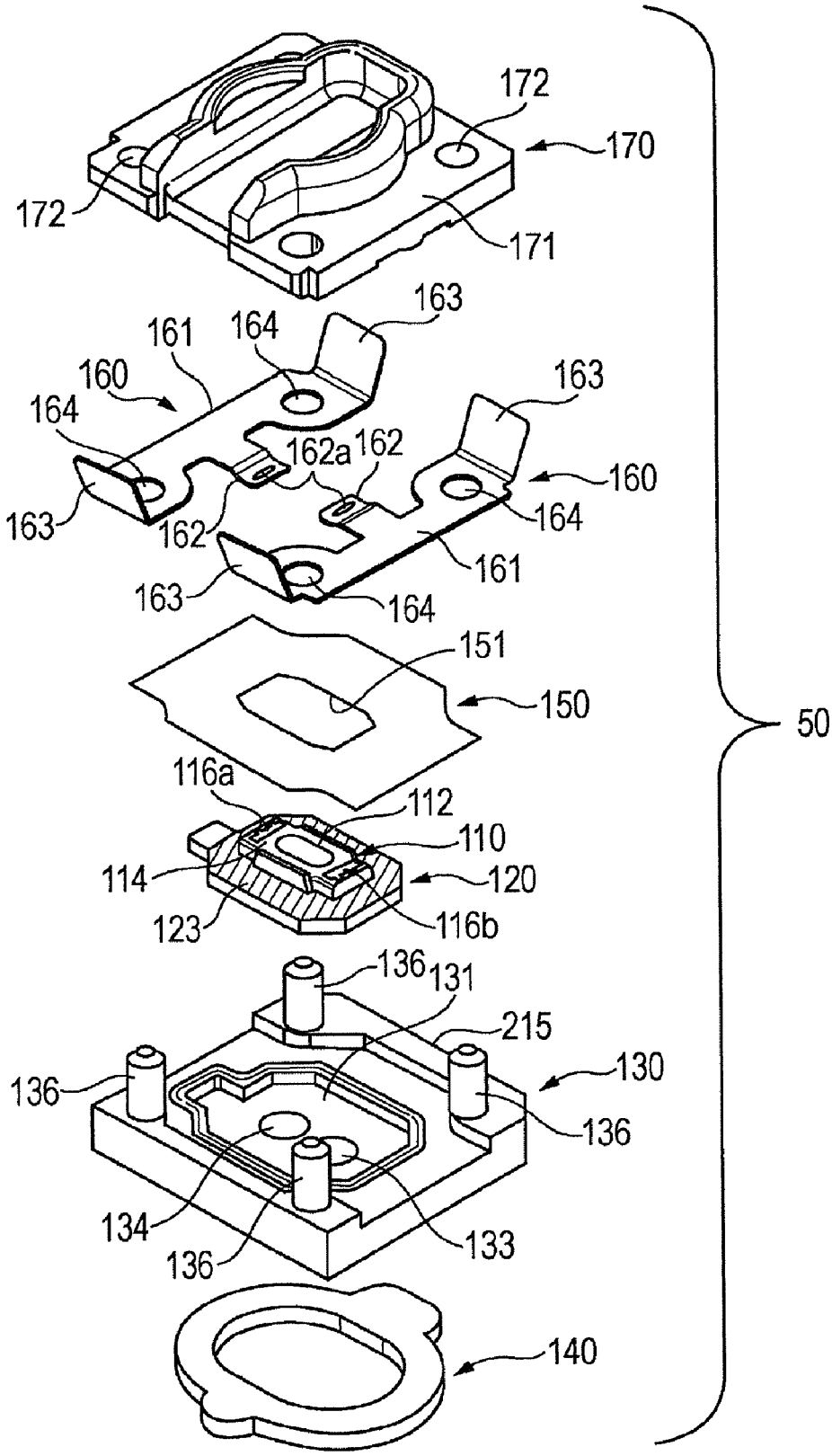
FIG. 5 is a decomposition perspective view of the remaining amount detecting means shown in FIG. 4.

The sensor unit 50 is constituted by a sensor chip (circuit chip) 110, a sensor base 120, a unit base 130, a seal ring 140, an insulation film 150, a pair of connection terminal plates 160, and a pressing cover 170 as shown in FIG. 5. The sensor chip 110 is a remaining amount detecting means which detects the ink remaining amount in the tank main body 35 based on variations in free vibration when vibration of a piezoelectric element is applied to the ink flow path. The sensor base 120 made of metal is fixed and equipped to the bottom surface of the sensor chip 110 to improve the vibration property (acoustical property) of the sensor chip 110. The unit base 130 made of resin has a concave portion 131 in which the sensor base 120 is closely fitted and determines the position of the sensor chip 110 in the sensor placed concave portion 35*a*. The seal ring 140 is adhered to the bottom surface of the unit base 130 and seals between the bottom surface of the sensor placed concave portion 35*a* and the unit base 130. The insulation film 150 has an opening 151 into which the sensor chip 110 is inserted at the center and covers the upper surface 123 of the sensor base 120 fitted and attached to the unit base 130 and the upper surface of the unit base 130 spreading around the sensor base 120. The pair of connection terminal plates 160 are attached to the unit base 130 from the upper side of the insulation film 150. The pressing cover 170 presses the pair of the connection terminal plates 160 to the unit base 130.

An approximately rectangular plate-like chip main body 111 is a vibration plate in the sensor chip 110 as shown in FIGS. 6 to 9A. A piezo element 112 as a piezoelectric element is disposed at the center of the upper surface of the chip main body 111. An upper electrode and a lower electrode not shown are respectively connected to chip contact points 116*a* and 116*b*.

A concave portion 113 communicating with the ink flow path opened at the bottom of the sensor placed concave portion 35*a* is formed at the center of the bottom surface of the chip main body 111. The center of the upper surface of the chip main body 111 which is the vibration plate is thinned by formation of the concave portion 113.

The upper surface of the chip main body 111 is a flat connection outer surface 114. The pair of chip contact points 116*a*, 116*b* are provided near a pair of opposite sides of the connection outer surface 114 so as to extend along edges 115*a*, 115*b* (see FIG. 8) of the opposite sides. The chip contact points 116*a*, 116*b* are the contact points for electrically connecting to the piezo element 112 on the chip main body 111.

The structure of the chip contact point 116*a*, 116*b* which is characteristic of the embodiment will be described below in detail.

Figure 6:
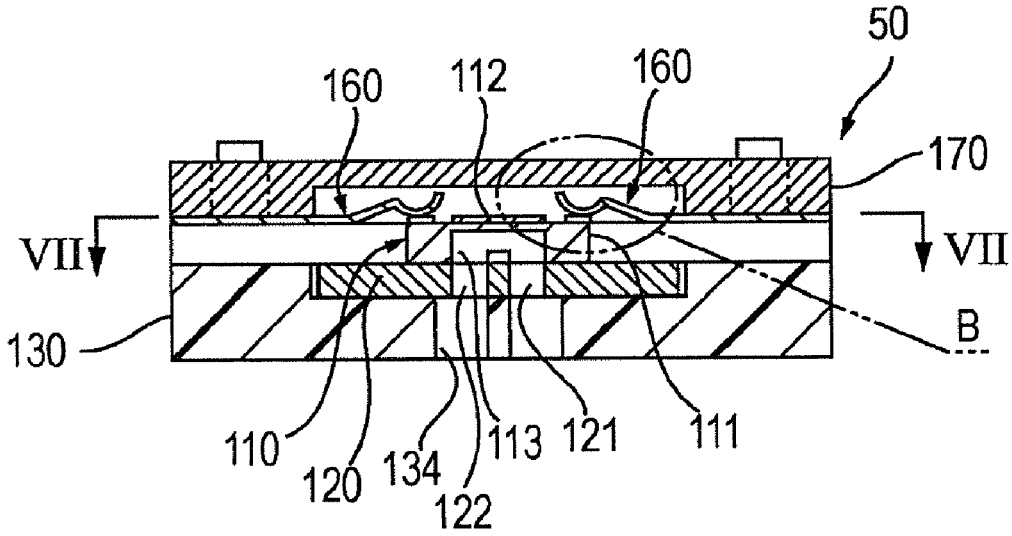
FIG. 6 is an enlarged view of portion A in FIG. 3.

Two through holes 121, 122 communicating with the concave portion 113 of the chip main body 111 are formed in the sensor base 120 as shown in FIG. 6.

Two through holes 133, 134 communicating with the concave portion 113 of the chip main body 111 via the two through holes 121, 122 of the sensor base 120 are formed around the center of the concave portion 131 of the unit base 130. Each of the through holes 133, 134 communicates with the ink flow path opened at the bottom of the sensor placed concave portion 35*a*.

Accordingly, when there is ink in the ink flow path in the tank main body 35, the ink in the ink flow path flows through each of the holes 121, 122, 133, 134 as an ink flow path and flows into the concave portion 113 to form a vibration system in which the system vibration property changes according to the presence or absence of a bubble in the ink when vibration is applied from the sensor chip 110.

The seal ring 140 stuck on the bottom surface of the unit base 130 seals the surrounding area of the connection portion of the through holes 133, 134 and the ink flow path of the tank main body 35 side.

A pole 136 for supporting the pair of connection terminal plates 160, 160 and the pressing cover 170 is provided at each of the four corners of the upper surface of the unit base 130.

Figure 7:
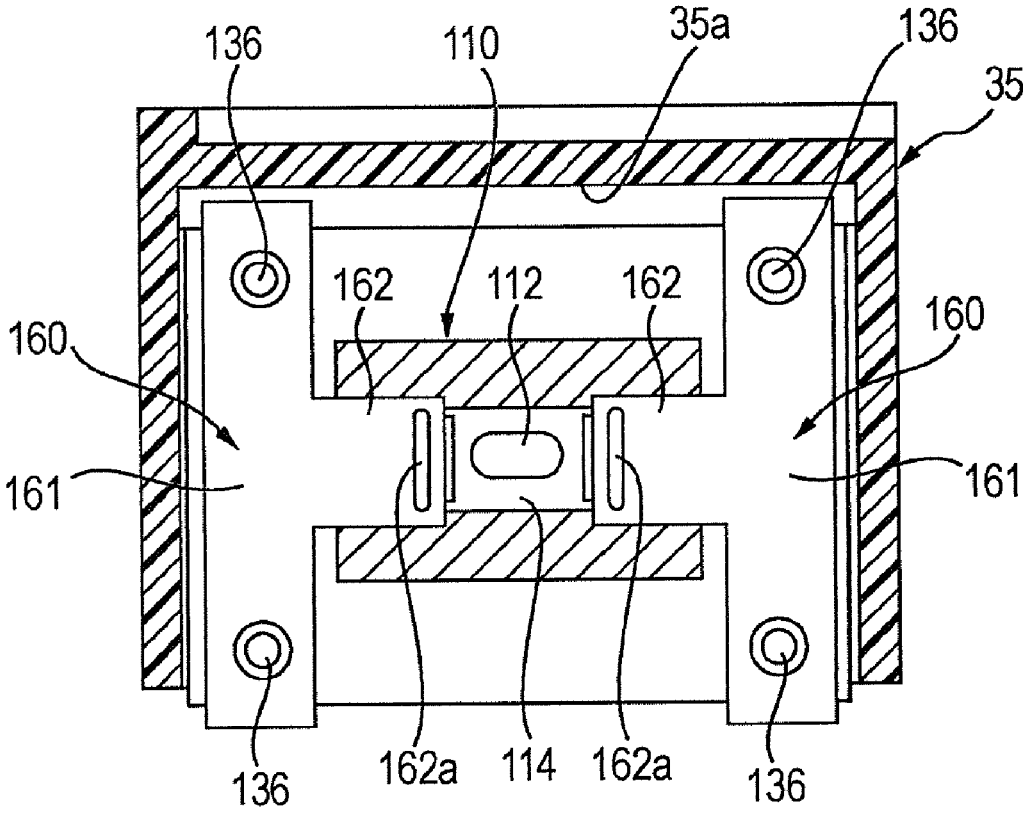
FIG. 7 is a cross sectional view taken along the line VII-VII of FIG. 6.

As shown in FIGS. 5 and 7, each of the connection terminal plates 160 includes a main body plate portion 161, a chip contact piece 162, and substrate contact pieces 163. The main body plate portions 161 are positioned at the outer sides of the edges 115*a*, 115*b* (see FIG. 8) of the pair of opposite sides of the chip main body 111 so as to extend along the edges 115*a*, 115*b* and fixed to the unit base 130. The chip contact pieces 162 extend on the connection outer surface 114 of the chip main body 111 from the centers of the main body plate portions 161 and distal ends of the chip contact pieces 162 make contact with the chip contact points 116*a*, 116*b*. The substrate contact pieces 163 extend from both ends of the main body plate portion 161 along the longitudinal directions of the main body plate portion 161 and make contact with sensor contact points (not shown) formed on the back surface of the circuit substrate 81.

Attaching holes 164 for fitting the poles 136 of the unit base 130 are formed at the vicinity of the both ends of the main body plate portion 161. The position of the main body plate portion 161 on the unit base 130 is determined by inserting the poles 136 into the attaching holes 164. That is, the pair of connection terminal plates 160, 160 are positioned at a predetermined position in the sensor placed concave portion 35*a* via the unit base 130.

A bent portion 162*a* having a convex at the chip contact point 116*a*, 116*b* side is formed in each of the distal ends of the chip contact pieces 162.

Further, the substrate contact piece 163 is provided at a slant so as to obtain a required contact pressure by elastic deformation and to be able to tolerate dimension error when the substrate contact piece 163 makes contact with a sensor contact point (not shown) of the back surface of the circuit substrate 81.

In the case of this embodiment, the IC chip substrate 80 corresponds to another circuit which is a circuit different from the sensor chip 110. Accordingly, the substrate contact pieces 163 of the pair of contact terminal plates 160, 160 correspond to other circuit connection portions conductively connecting the sensor contact points on the IC chip substrate 80 which is the other circuit to the chip contact points 116*a*, 116*b*.

The chip contact points 116*a*, 116*b* of the sensor chip 110 conductively connected to the sensor contact points on the IC chip substrate 80 via the pair of the connection terminal plates 160, 160 are connected with connection terminals of the cartridge attached portion 18 side via the substrate contact points 83 of the front surface of the IC chip substrate 80. Such a conductive connection allows the control of the operation of the sensor chip 110 as the remaining amount detection means from the side of the ink jet type recording device 10.

Attaching holes 172 to which the poles 136 of the unit base 130 are fitted are provided at four corners of a flat plate portion 171 covered on each main body plate portion 161 of the pair of connection terminal plates 160 in the pressing cover 170. The main body plate portions 161 are sandwiched between the pressing cover 170 and the unit base 130 and the pair of connection terminal plates 160 are fixed to the unit base 130 by the pressing cover 170.

In the case of this embodiment, a pair of extending portions 119, 119 which reach the ends (that is, edges 115*a*, 115*b* of the opposite sides) of one side of the connection outer surface 114 are provided to the pair of chip contact points 116*a*, 116*b* equipped to the pair of opposite sides of the chip main body 110 at the rims 118 positioned at one sides (main body plate portion 161 side) of the connection outer surface 114 to which the corresponding chip contact pieces 162 extend.

Further, a predetermined minimum gap distance is assured between the edge 115*b* (115*a*) of the opposite side of the connection outer surface 114 opposing the edge 115*a* (115*b*) to which the extending portion 119 of the chip contact point 116*a* (116*b*) extends and the chip contact point 116*b* (116*a*).

To be more specific, in the case of this embodiment, the extending directions of the chip contact pieces 162 toward each chip contact point 116*a*, 116*b* are oppositely oriented to each other, so that the extending portions 119 formed to each chip contact point 116*a*, 116*b* extend in the opposite directions with respect to the opposing chip contact points 116*a*, 116*b* and reach the edges 115*a*, 115*b* of the opposite sides of the connection outer surface 114.

Figure 8:
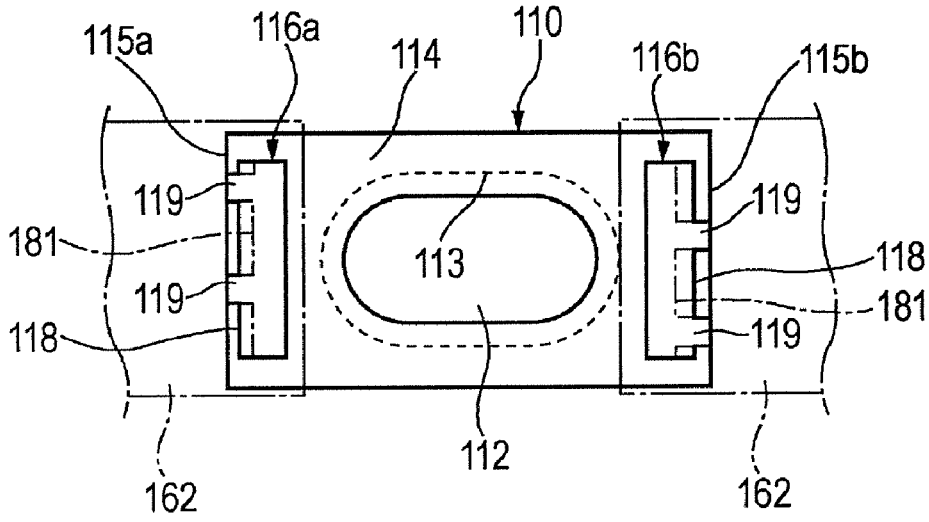
FIG. 8 is an enlarged view around the circuit chip shown in FIG. 7.

Then, as shown in FIG. 8, the positions of each extending portion 19 of the opposing each chip contact point 116*a*, 116*b* are set so as not to be overlapped in the opposing direction of each chip contact point 116*a*, 116*b* (horizontal direction in FIG. 8).

In the structure of the sensor chip 110 according to the ink cartridge 31 of the embodiment, the extending portions 119 reaching the edge 115*a* (115*b*) of one side of the connection outer surface 114 are provided to the chip contact point 116*a* (116*b*) on the connection outer surface 114 of the sensor chip 110 at the rim 118 positioned at one side of the connection outer surface 114 to which the chip contact piece 162 extends.

Figure 10:
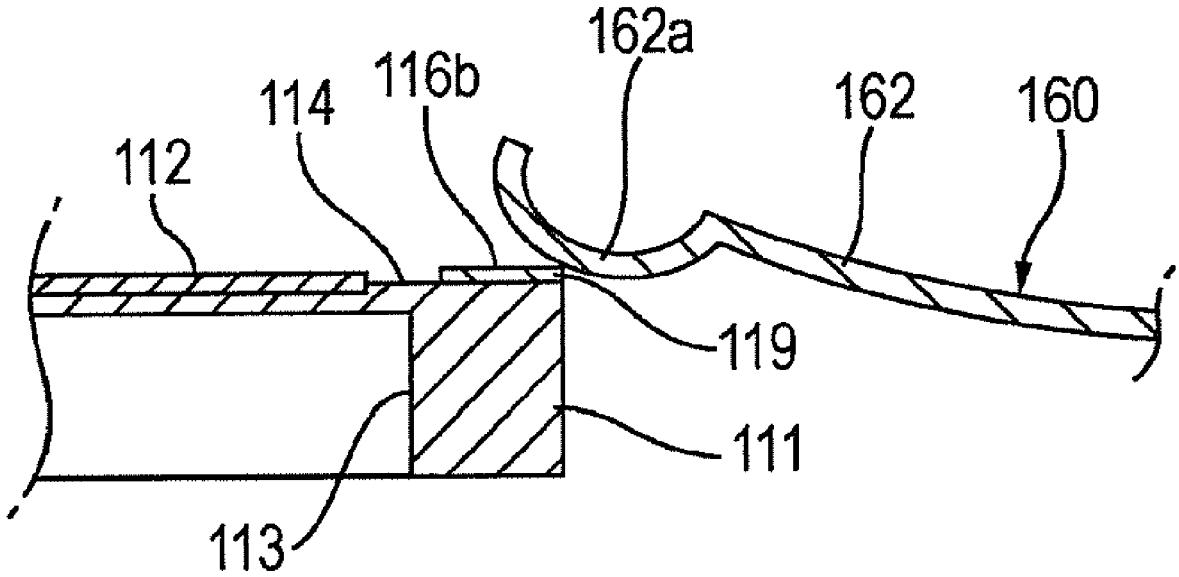
FIG. 10 is an illustration view of the state where the chip contact piece is misaligned to the chip contact point in the direction in which the length of the chip contact piece extending on the connection outer surface is reduced.

Consequently, the distal end of the chip contact piece 162 can surely make contact with the extending portions 119 even when the position of the chip contact piece 162 is misaligned in the direction in which the length of the chip contact piece 162 extending on the connection outer surface 114 of the chip main body 111 is reduced and the distal side of the chip contact piece 162 is positioned on the edge 115*b* (115*a*) of the connection outer surface 114 as shown in FIG. 10 due to the assembling error of mutual parts, size tolerance of each part, and the like when the sensor chip 110 and the connection terminal plate 160 are assembled to the tank main body 35.

That is, the chip contact point 116*b* (116*a*) of the sensor chip 110 and the chip contact piece 162 of the connection terminal plate 160 assembled to the tank main body 35 can be surely conductively connected by only managing the position of the chip contact piece 162 so that the length of the chip contact piece 162 extending on the connection outer surface 114 of the chip main body 111 is reduced.

Figure 9A:
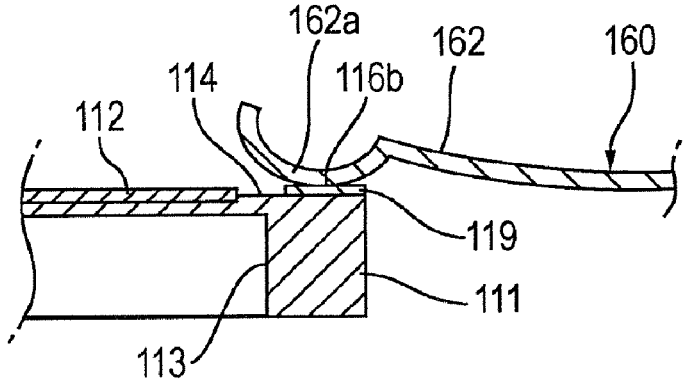
FIGS. 9A and 9B are each an enlarged view of portion B in FIG. 6
Figure 9B:
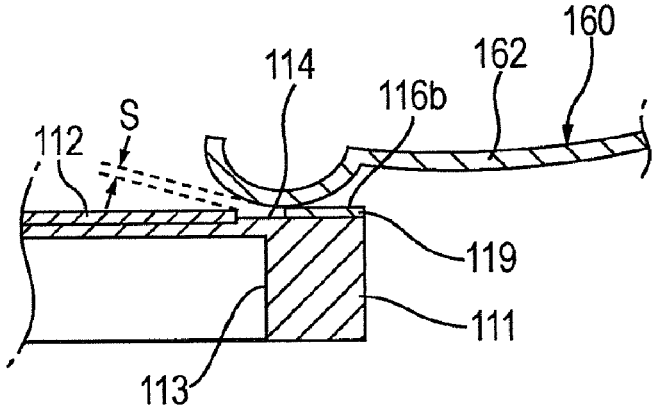

Accordingly, the fear of the occurrence of the positional misalignment of the chip contact piece 162 in the direction in which the length of the chip contact piece 162 extending on the connection outer surface 114 is increased due to the assembling error and size tolerance of each part and the like is reduced. Consequently, as shown in FIG. 9B for example, the disadvantage that the gap distance S between the chip contact piece 162 and the piezo element 112 and the like disposed at the inner side of the chip contact point 116*b* (116*a*) becomes too small, and the chip contact piece 162 makes contact with the sensor chip 110 at a location other than the chip contact point 116*b* (116*a*), can be avoided.

In addition, the chip contact point 116*a*, 116*b* of the sensor chip 110 and the chip contact piece 162 of the connection terminal plate 160 assembled to the tank main body 35 can be surely conductively connected without having to try to reduce positional misalignment by the approach of enhancing the assembling accuracy of each part to the tank main body 35 and without improving the manufacturing accuracy of each part. Accordingly, the cost reduction can be realized and the productivity can be improved by reducing the manufacturing cost by reducing the assembling accuracy and manufacturing accuracy.

Further, there is no need for extending the size of the chip contact point 116*a*, 116*b* and the edge of the chip main body 111 in the direction of positional misalignment generated by the assembling error of mutual parts, size tolerance of each part, and the like in order to ensure the conductive connection between the chip contact point 116*a*, 116*b* of the sensor chip 110 and the chip contact piece 162 of the connection terminal plate 160 assembled to the tank main body 35. Accordingly, the upsizing of the sensor chip 110 due to the extension of the size can be prevented. As a result, the ink cartridge 31 to which the sensor chip 110 is assembled can be downsized.

Further, a predetermined minimum gap distance is assured between the edge 115*b* (115*a*) of the opposite side of the connection outer surface 114 opposing the edge 115*a* (115*b*) to which the extending portion 119 of the chip contact point 116*a* (116*b*) extends and the rim 118 of the chip contact point 116*b* (116*a*). That is, the positions of each extending portions 119 of opposing each chip contact point 116*a*, 116*b* are set so as not to be overlapped in the opposing direction of each chip contact point 116*a*, 116*b* (horizontal direction in FIG. 8).

Consequently, when, for example, a large number of sensor chips 110 are formed on one wafer in an adjacent manner in the manufacturing process of the sensor chip 110, no continuation of the chip contact point 116*a* and the chip contact point 116*b* occurs between the adjacent sensor chips 110.

Accordingly, the productive efficiency of the sensor chip 110 can be improved by employing the production method in which polarization process is collectively performed before the large number of sensor chips 110 formed on one wafer in an adjacent manner are separated to each other.

In addition, in the sensor chip 110 of the embodiment, the chip contact points 116*a*, 116*b* are respectively provided near the opposite sides of the flat connection outer surface 114 of the sensor chip 110, and the extending portions 119 of opposing each chip contact point 116*a* (116*b*) extend to the opposite side of the opposing chip contact point 116*b* (116*a*) to reach the edge 115*a* (115*b*) of one side of the connection outer surface 114. Further, the positions of the extending portions 119 of the opposing each chip contact 116*a*, 116*b* are set so as not to be overlapped in the opposing direction of each chip contact point 116*a*, 1116*b*.

Consequently, by providing a plurality of the extending portions 119 in a comb tooth manner as shown in FIG. 8, the contact area of the chip contact piece 162 can be increased to improve the conductive capability. In addition, a reduction portion 181 shown by the imaginary line in FIG. 8 may be formed to a strip-shaped conductor portion extending along the edge 115*a*, 115*b* of the opposite side. This makes it possible to save the resource of the conductor by reducing the width of the conductor.

It should be noted here that the formed position of the extending portion 119 provided to the chip contact point 116*a*, 116*b* of the chip main body 111 varies in accordance with the direction of the chip contact piece 162 of the connection terminal plate 160 extending on the connection outer surface 114 of the chip main body 111.

FIGS. 11A to 12B each shows a sensor unit of an ink cartridge according to a second embodiment or a third embodiment of the invention where the direction of the chip contact piece 162 extending on the chip main body 111 is changed.

Figure 11A:
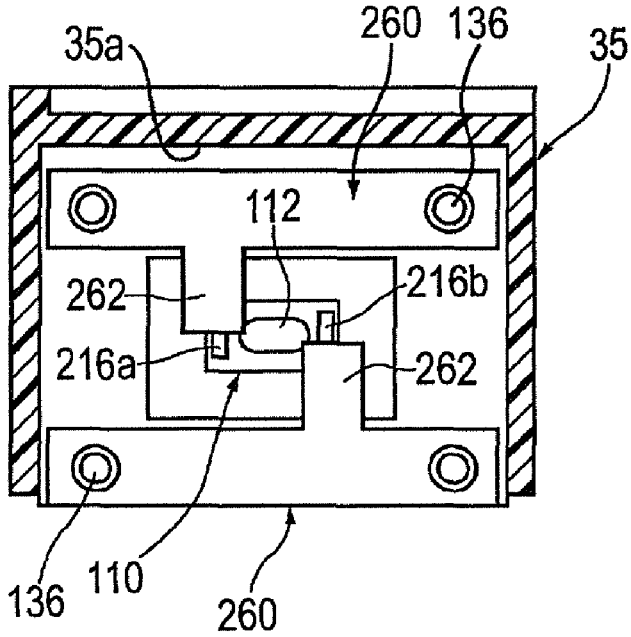
FIG. 11A is a plan view showing a positional relationship between a circuit chip and a connection terminal plate in an ink cartridge according to a second embodiment.
Figure 11B:
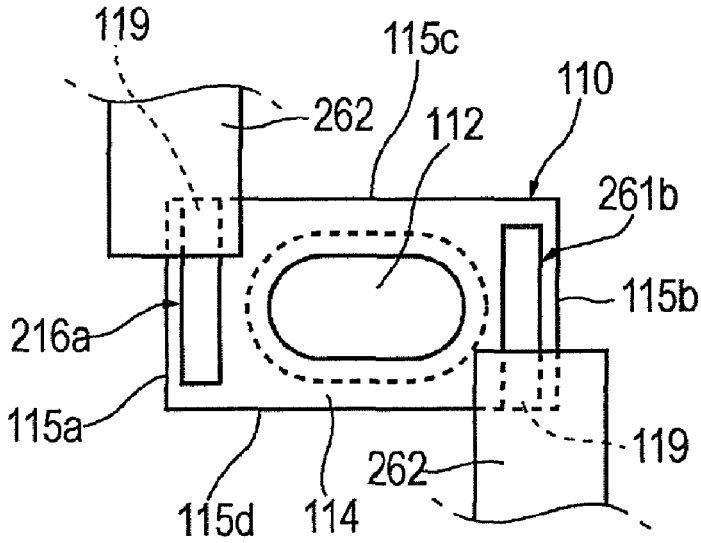
FIG. 11B is an enlarged view around the circuit chip shown in FIG. 11A.

In the case of the second embodiment shown in FIGS. 11A and 11B, a pair of connection terminal plates 260, 260 are separately disposed in the short direction of the sensor chip 110 to sandwich the sensor chip 110.

The chip contact pieces 262 of each connection terminal plate 260 are mutually extending on the connection outer surface 114 along the longitudinal direction of each chip contact point 216*a*, 216*b* on the chip main body 111 from opposite sides as shown in FIG. 11B.

That is, the extending directions of the chip contact pieces 262 are opposite for each chip contact point 216*a*, 216*b*, so that the equipped position of the extending portion 119 reached to the edge 115*c* (115*d*) of the connection outer surface 114 from a rim of each chip contact point 216*a*, 216*b* is opposite side for each chip contact point 216*a*, 216*b*.

Figure 12A:
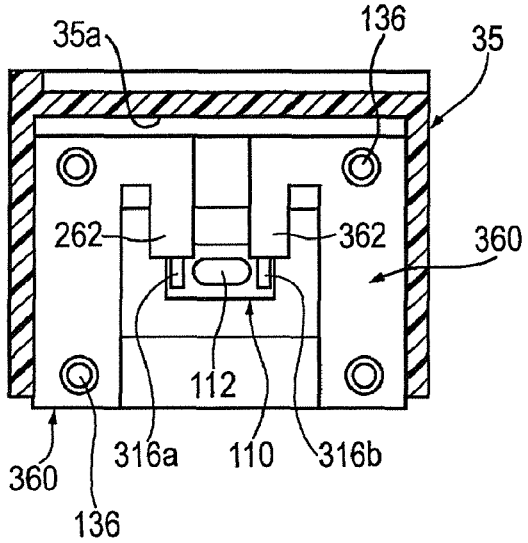
FIG. 12A is a plan view showing a positional relationship between a circuit chip and a connection terminal plate in an ink cartridge according to a third embodiment.
Figure 12B:
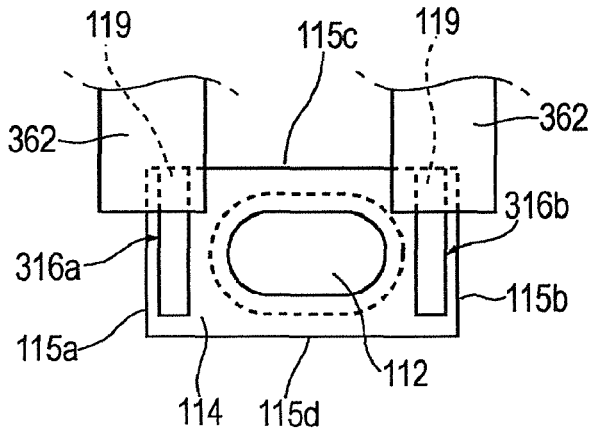
FIG. 12B is an enlarged view around the circuit chip shown in FIG. 12A.
Figure 13:
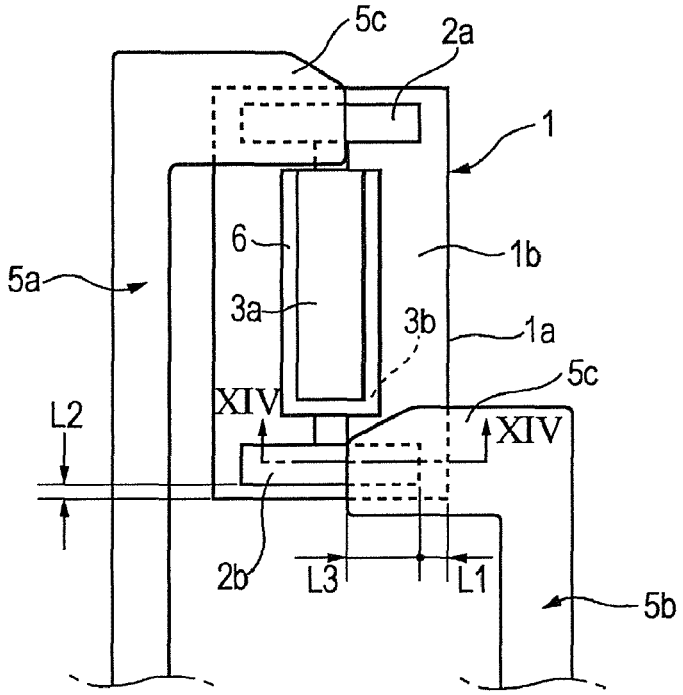
FIG. 13 is a plan view showing a conductive structure of a chip contact point and a chip contact piece of a circuit chip assembled to a tank main body as remaining amount detecting means in a conventional ink cartridge.
Figure 14A:
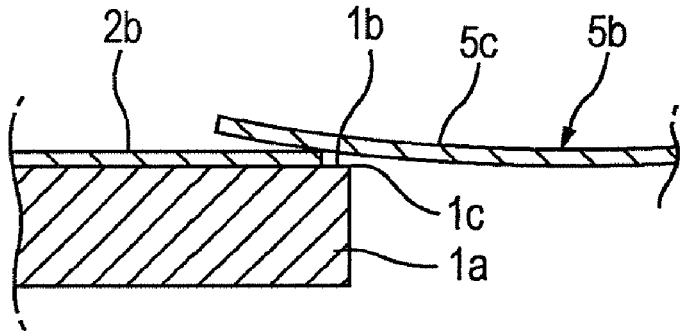
FIGS. 14A and 14B are each a cross sectional view taken along the line XIV-XIV of FIG. 13.
Figure 14B:
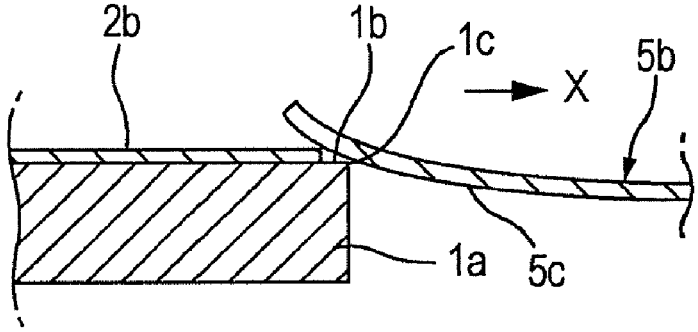

In the case of the third embodiment shown in FIGS. 12A and 12B, a pair of connection terminal plates 360, 360 are separately disposed in the long direction of the sensor chip 110 to sandwich the sensor chip 110.

The chip contact piece 362 of each connection terminal plate 360 is extending on the connection outer surface 114 along the longitudinal direction of each chip contact point 316*a*, 316*b* on the chip main body 111 from the same side (upper side in FIG. 12B) as shown in FIG. 12B.

That is, the extending directions of the chip contact piece 362 are the same for the both chip contact points 316*a*, 316*b*, so that the equipped position of the extending portion 119 reached to the edge 115*c* (115*d*) of the connection outer surface 114 from a rim of each chip contact point 316*a*, 316*b* is the same side for each chip contact point 316*a*, 316*b*.

According to the sensor units of the ink cartridges according to the second and third embodiments, similarly to the sensor unit 50 of the ink cartridge 31 according to the first embodiment, the distal end of the chip contact piece 262 (362) can surely make contact with the extending portion 119 even when the position of the chip contact piece 262 (362) is misaligned in the direction in which the length of the chip contact piece 262 (362) extending on the connection outer surface 114 of the chip main body 111 is reduced and the distal side of the chip contact piece 262 (362) is positioned on the edge 115*c* (and 115*d*) of the connection outer surface 114 due to the assembling error of mutual parts, size tolerance of each part, and the like when the sensor chip 110 and the connection terminal plate 260 (360) are assembled to the tank main body 35.

It should be noted here that the application of the liquid storage tank according to the invention in not limited to the ink cartridge shown in the above embodiments. In addition, the liquid consumption device equipped with the tank attached portion to which the liquid storage tank of the invention is attached is not limited to the ink jet type recording device shown in the above embodiments.

Various devices equipped with a tank attached portion to which the liquid storage tank is attached in a detachable manner and in which the liquid stored in the liquid storage tank is supplied to the device fall under the category of the liquid consumption device. As concrete examples, there are included a device equipped with a color material ejection head for use in color filter manufacturing such as a liquid crystal display, a device equipped with an electrode material (conductive paste) ejection head for use in electrode formation such as an organic EL display and a field emission display (FED), a device equipped with a living organic matter ejection head for use in bio chip manufacture, a device equipped with a sample ejection head as an accurate pipette, and the like.

What is claimed is:

1. A liquid storage tank comprising:

a tank main body for storing a liquid supplied to a liquid consumption device and attached to a tank attached portion of the liquid consumption device in a detachable manner;

a circuit chip equipped with a pair of chip contact points on a flat connection outer surface on a chip main body positioned at a predetermined position of the tank main body; and a pair of connection terminal plates each including:

a chip contact piece positioned around the circuit chip in the tank main body and extending on the connection outer surface from one side of the connection outer surface to make contact with the corresponding chip contact point, and another circuit connection portion conductively connected to a contact point of another circuit, the pair of connection terminal plates conductively connecting the corresponding chip contact point to the other circuit;

wherein each chip contact point has an extending portion extending to an edge of one side of the connection outer surface at a rim positioned at one side of the connection outer surface to which the corresponding chip contact piece extends.

2. The liquid storage tank according to claim 1, having a predetermined minimum gap distance between the edge of the opposite side of the connection outer surface opposing the edge to which the extending portion extends and the rim of the chip contact point.

3. The liquid storage tank according to claim 1, wherein:

the pair of chip contact points are respectively provided at the opposite sides of the connection outer surface of the circuit chip, thereby providing opposing chip contact points;

the respective extending portions of each of the opposing chip contact points respectively extend toward the opposite side with respect to the opposing chip contact points to reach the edge of one side of the connection outer surface; and the positions of the extending portions of the opposing chip contact points are set so as not to overlap with the extending portions on the opposite side.

* * * * *